US009677752B2

(12) United States Patent
Jonsson et al.

(10) Patent No.: US 9,677,752 B2
(45) Date of Patent: Jun. 13, 2017

(54) LIGHT EMITTING DIODE (LED) LIGHTING SYSTEM

(71) Applicant: ESJONSSON EHF, Gardabaer (IS)

(72) Inventors: Sturla Jonsson, Kopavogi (IS); Jon Kristjansson, Gardabaer (IS); Thorgeir Jonsson, Kopavogi (IS)

(73) Assignee: ESJONSSON EHF, Gardabaer (IS)

( * ) Notice: Subject to any disclaimer, the term of this patent is extended or adjusted under 35 U.S.C. 154(b) by 0 days.

(21) Appl. No.: 14/654,010

(22) PCT Filed: Dec. 18, 2013

(86) PCT No.: PCT/IS2013/000004

§ 371 (c)(1),
(2) Date: Jun. 19, 2015

(87) PCT Pub. No.: WO2014/097324

PCT Pub. Date: Jun. 26, 2014

(65) Prior Publication Data

US 2015/0316246 A1 Nov. 5, 2015

(30) Foreign Application Priority Data

Dec. 19, 2012 (IS) ..... 9017
Jul. 25, 2013 (EP) ..... 13003722

(51) Int. Cl.
*F21V 29/54* (2015.01)
*F21V 29/70* (2015.01)
(Continued)

(52) U.S. Cl.
CPC ..... *F21V 29/54* (2015.01); *F21V 29/70* (2015.01); *F21V 29/713* (2015.01); *F21K 9/00* (2013.01);
(Continued)

(58) Field of Classification Search
CPC ..... F21V 29/54; F21V 29/70; F21V 29/713; F21V 29/773; F21V 29/777; F21V 29/20;
(Continued)

(56) References Cited

U.S. PATENT DOCUMENTS 6,012,291 A 1/2000 Ema
6,639,360 B2 * 10/2003 Roberts ..... F21V 29/54 257/E23.087
(Continued)

FOREIGN PATENT DOCUMENTS

JP 2007258520 A 10/2007
JP 2012119521 A 6/2012
(Continued)

OTHER PUBLICATIONS

International Search Report for corresponding International PCT Application No. PCT/IS2013/000004, Mar. 5, 2014.
(Continued)

*Primary Examiner* — Bao Q Truong
(74) *Attorney, Agent, or Firm* — Workman Nydegger

(57) ABSTRACT

A light emitting diode (LED) lighting system including a first heat dissipation structure having a front side acting as a contact area to at least one LED and a back side. At least one second heat dissipation structure is positioned adjacent to the backside of the first heat dissipation structure. At least one thermoelectric module is positioned between the first heat dissipation structure. At least one second heat dissipation structure for conducting heat is produced from the at least one LED during operation from the first heat dissipation structure towards the at least one second heat dissipation structure. The front side of the first heat dissipation structure comprises at least one upwardly protruding structure extending distally away from the at least one second heat dissipation structure and the at least one upwardly
(Continued)

protruding structure acts as the contact point to the at least one LED.

10 Claims, 9 Drawing Sheets

(51) Int. Cl.

| | |
|---|---|
| ***F21V 29/71*** | (2015.01) |
| *F21V 29/00* | (2015.01) |
| *F21K 9/00* | (2016.01) |
| *F21V 29/77* | (2015.01) |
| *F21Y 101/00* | (2016.01) |
| *F21Y 115/10* | (2016.01) |
| *F21Y 107/50* | (2016.01) |

(52) U.S. Cl.
CPC ..... *F21V 29/20* (2013.01); *F21V 29/773* (2015.01); *F21V 29/777* (2015.01); *F21Y 2101/00* (2013.01); *F21Y 2107/50* (2016.08); *F21Y 2115/10* (2016.08)

(58) Field of Classification Search
CPC ..... F21Y 2115/10; F21Y 2107/50; F21Y 2101/00; F21K 9/00
See application file for complete search history.

(56) References Cited

U.S. PATENT DOCUMENTS

| | | | | |
|---|---|---|---|---|
| 6,964,501 | B2 * | 11/2005 | Ryan | F21V 29/004 362/294 |
| 7,510,303 | B2 * | 3/2009 | Jonsson | H01L 35/00 362/294 |
| 8,845,134 | B2 | 9/2014 | Chiba et al. | |
| 8,975,504 | B2 | 3/2015 | Yoon | |
| 2004/0114355 | A1 | 6/2004 | Rizkin et al. | |
| 2006/0198149 | A1 | 9/2006 | Jonsson et al. | |
| 2010/0084979 | A1 | 4/2010 | Burton et al. | |
| 2011/0025211 | A1 | 2/2011 | Bae | |
| 2011/0042056 | A1 | 2/2011 | Bae | |
| 2013/0003393 | A1 | 1/2013 | Chiba et al. | |
| 2013/0081666 | A1 | 4/2013 | Yoon | |

FOREIGN PATENT DOCUMENTS

| | | | |
|---|---|---|---|
| KR | 20090103263 | A | 10/2009 |
| WO | 2010002159 | A2 | 1/2010 |
| WO | 2011108571 | A1 | 9/2011 |
| WO | 2011159077 | A2 | 12/2011 |
| WO | 2012015161 | A1 | 2/2012 |

OTHER PUBLICATIONS

Iceland Search Report from Application No. SE 201300043, Apr. 17, 2013.

* cited by examiner

LIGHT EMITTING DIODE (LED) LIGHTING SYSTEM

FIELD OF THE INVENTION

The present invention relates to a light emitting diode (LED) lighting system and an assembly forming such a LED system.

BACKGROUND OF THE INVENTION

Practical design and application of Light Emitting Diodes (LED) type devices for use in Area Lighting and like schemes are limited by thermal energy-management issues. Therefore, by producing more light intensive LEDs more thermal energy is produced in the same unit volume of the device. Practical design of a LED light aims at finding the passive point and the optimal balance between the light output versus the entropy.

It is known that LEDs exhibit negative temperature coefficient aspects, at fixed power input, as the device's operating heat rises (entropy), the device's light output decreases. It is the entropy inside the LED chip and the semiconductors accompanied with it that determines the degradation level of the LED.

Attempts have been made in the prior art to solve the negative temperature coefficient issues. As an example, in LED highway traffic signal devices housings with ventilation configurations, both of passive (convection-type) and active (fan-driven-type) have been provided to prevent the LED-s from overheating. Present art LED traffic signal devices also address the inherent negative temperature coefficient nature via the electrical power supply. These approaches either increase power to the device to compensate for light output loss or address the form of the provided electrical power such as sine vs. square wave in an attempt to moderate the entropy. According to prior art, entropy in a closed system; as LEDs, will continue to increase until the LED no longer produces any light. All passive systems show similar development. The higher the current, the bigger portion of the power consumed becomes entropy. Entropy can not decrease in any system but it can at best, be constant.

This is only possible in active cooling systems, where external work is needed to keep the entropy inside the system at acceptable levels.

Solid state thermoelectric modules (TEM) also referred to as thermoelectric coolers (TEC) or heat pumps have been used in various applications since the introduction of semiconductor thermocouple materials. Such devices convert electrical energy into a temperature gradient, known as the "Peltier" effect or convert thermal energy from a temperature gradient into electrical energy. By applying a current through a TEM a temperature gradient is created and heat is transferred from one side, the "cold" side of the TEM to the other side, the "hot" side.

TEMs have been considered unsuitable for cooling LED lighting devices as they have been ruled out for insufficient efficiency; that is, if configured and operated with conventional settings the energy cost of operating a TEM for cooling an LED device is more than the energy gained in operating the LED at a reduced current and a slower entropy incensement's.

There is thus a need for providing an improved LED system that overcomes the above mentioned drawbacks.

SUMMARY OF THE INVENTION

It would be advantageous to achieve an improved reflector system that is capable of increasing the field of view without enlarging the system.

According to a first aspect of the invention, a light emitting diode (LED) lighting system is provided, comprising:

- a first heat dissipation structure having a front side and a back side, the front side acting as a contact area to at least one LED,
- at least one second heat dissipation structure positioned adjacent to the backside of the first heat dissipation structure, and
- at least one thermoelectric module positioned between the first heat dissipation structure and the at least one second heat dissipation structure for conducting heat produced from the at least one LED during operation from the first heat dissipation structure to towards the at least one second heat dissipation structure, wherein the front side of the first heat dissipation structure comprises at least one upwardly protruding structure extending distally away from the at least one second heat dissipation structure and where the at least one upwardly protruding structure acts as the contact point to the at least one LED.

The inventors of the present invention have surprisingly realized that the heat transfer from the first heat dissipation structure towards the at least one second heat dissipation structure via the at least one thermoelectric module occurs around the at least one upwardly protruding structure, i.e. at the surface base level of the first heat dissipation structure. Assuming that the first heat dissipation structure comprises a single upwardly protruding structure extending form a surface base level of the first heat dissipation structure, the surface base level around this single upwardly protruding structure will be hotter than the up most point on the upwardly protruding structure where the LED is attached to the first heat dissipation structure. Moreover, the temperature of the LED may easily be maintained at a temperature close to the ambient temperature at all times, which obviously results in much longer lifetime of the LED.

In one embodiment, the at least one thermoelectric module comprises at least one thermoelectric cooler (TEC) having a first side and a second side, where the at least one TEC is connected to a power source that supplies electrical current and thus electrical energy into the at least one TEC, where the TEC converts the electrical energy into a temperature gradient between the first and the second side along a vertical axis through the heat dissipating structures so as to allow the heat conduct from the first heat dissipation structure towards the at least one second heat dissipation structure. Surprisingly, such TEC or TECs can surprisingly be used to cool and enhance the light output of LED lighting fixtures and particularly to maintain optimal light output from LED lighting fixtures. Further investigations have shown that besides abovementioned benefits of using TEC they prolong the expected lifetime of LEDs, improve the color rendering index (CRI) and prevent the LED structure from collapse through Droop. Such a LED system may as an example be used in traffic signals and area lighting devices.

The LED may be of any conventional type, such as hi-flux LEDs, in all areas where bright light is needed.

It will be appreciated that the device of invention is able to produce more light per unit energy consumed, than corresponding LED-based lights without cooling, because the additional energy needed to operate the TEC is less than the energy and/or light output gained. Hence, in the most preferred embodiments of the invention, the device is configured such that the device produces more Illumination per unit consumed power when the TEM-operating current (referred to herein as TOC) through the TEM is applied to the TEM, than the illumination produced per unit consumed power when no TOC is applied to the TEM.

In one embodiment, the front side of the first heat dissipation structure comprises a plurality of upwardly protruding structures forming an array like front side of upwardly protruding structures, where the upwardly protruding structures act as contact points to at least one LED respective LED selected from plurality of LEDs. The LEDs may be attached to the front side via any type of thermal connection area on the LED and an equal area on the heat dissipating plate. Not limited to this embodiment the thermal energy generated by the LEDs spreads from the first heat dissipation structure towards the at least one second heat dissipation structure, which may be considered as the cold side of the LED system, via the valleys or groves between adjacent upwardly protruding structures. The development of the thermal flow shows that when plurality of heat sources, i.e. the LEDs, attached to the first heat dissipation structure are in operation, areas in the valleys/groves have a higher temperature than surrounding areas, i.e. the upwardly protruding structures. Accordingly, the valleys/groves act in a way as a heat "drain" for the heat produced by the LEDs from the first heat dissipating structure towards the at least one second heat dissipation structure. Accordingly, by moving the thermal flow from the heat source (LEDs) in this way the thermal velocity in the first heat dissipating structure becomes uneven distorting even distribution of S (Entropy) through the heat dissipating structure.

In one embodiment, the at least one upwardly protruding structure has a conical shape.

In one embodiment, the at least one TEC are controlled by a control unit and where the controlling includes adapting the supplied electrical energy to the ambient temperature.

In one embodiment, the at least one TEC are controlled by a control unit and where the controlling includes adjusting the current into the TEC such that the heat flow from the first heat dissipation structure towards the at least one second heat dissipation structure remains substantially constant.

In one embodiment, the at least one TEC are controlled by a control unit and where the controlling includes maintaining stable temperature around the at least one LED by means of reversing the temperature gradient between the first and the second side of the at least one TEC, and vice verse, by means of reversing the temperature gradient between the second and the first side of the at least on TEC, by means of reversing the current applied to the TEC. Accordingly, by operating the current that is applied to the TEC in this way via reversing, if necessary, the current the temperature of the LED or LEDs may be fully controlled at all times.

In one embodiment, the number of repetition between a second dissipation structures and thermoelectric modules is adapted to the geometrical size and or the power of the LED lighting system, where the larger or the more power the LED lighting system is the more will the repetition be between the second dissipation structure and thermoelectric modules.

In one embodiment, the surface/volume ration of the first and/or the at least one second heat dissipation structure is two or more.

In one embodiment, the at least one second heat dissipation structure are plate structure(s).

According to a second aspect, a heat dissipation structure is provided having a front side and a back side adapted to be used in relation to the above mentioned light emitting diode (LED) lighting system, where the heat dissipation structure has a front side adapted to act as a contact area to at least one LED and a back side, where the front side comprises at least one upwardly protruding structure adapted to act as contact point(s) to the at least one LED.

According to a third aspect, a light emitting diode (LED) lighting system assembly is provided, comprising:

a first heat dissipation structure having a front side and a back side, the front side acting as a contact area to at least one LED, at least one second heat dissipation structure adapted to be positioned adjacent to the backside of the first heat dissipation structure, and at least one thermoelectric module adapted to be positioned between the first heat dissipation structure and the at least one second heat dissipation structure for conducting heat produced from the at least one LED during operation from the first heat dissipation structure to towards the at least one second heat dissipation structure, wherein the front side of the first heat dissipation structure comprises at least one upwardly protruding structure extending distally away from the at least one second heat dissipation structure and where the at least one upwardly protruding structure acts as the contact point(s) to the at least one LED.

The inventors of the present invention have further realized following:

1. The importance of creating a constant sub ambient micro climate around the whole LED, the bigger the better. Thus lowering the thermal strain that elevated ambient temperature creates around the LED generally. Only active cooling can do that.
2. A better results are created by moving a part of the heat sink and attach it to the cold side of the TEM. The moved heat sink having as big surface area as possible and made of a high thermal conductivity material.
3. Dynamic electronic control can improve performance compared with static models.
4. Cooling LEDs affects many aspects of The LEDs performance. The frequency of the light waves can be fine tuned. The performance lowering droop effect is eliminated. Degradation is slowed by decades, producing longer lasting LEDs
5. Importance of marinating a temperature gradient big enough to move the heat
   (entropy) a few millimeters away from heat source thus lowering the thermal strain on the LED further lowering the junction temperature. The entropy remains constant during the operation of the light and or other semiconductors providing for
   a stable operating values and a prolonged operating lifetime of the light and or other semiconductors.
6. Common High flux LEDs improves their lumen performance such as the color rendering index, while having lower operating temperature.

DESCRIPTION OF EMBODIMENTS

The present invention relates to a light emitting diode (LED) lighting system and how to manage the thermal aspect in relation to LESs by creating another ambient heat environment around the LED. Further the present invention can utilize a higher current through the LED than presently is recommended resulting in a brighter LED and or fewer LEDs per light output.

Figure 1:
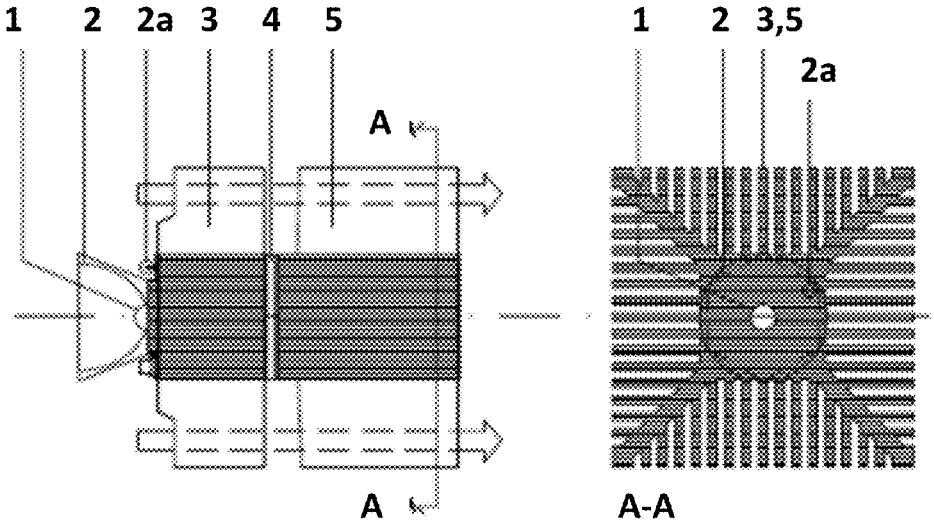
FIG. 1 shows a preferred embodiment of a lighting system according to the present invention. Elevation from the vertical side. Comprising (1) at least one LED light source, High flux LED and or electronic semiconductor device. (2) A lens and or reflective mirrors for the LED. (3) A first heat sink having a high volume and surface ratio between. (4) A peltier device facing the cold side to the (3) first heat sink and the hot side to the (5) second heat sink.

FIG. 1 shows a light emitting diode (LED) lighting system according to the present invention, comprising a first heat dissipation structure 3 having a front side and a back side, the front side acting as a contact area to at least one LED, at least one second heat dissipation structure 5 positioned adjacent to the backside of the first heat dissipation structure, and at least one thermoelectric module (TEM) 4 positioned between the first heat dissipation structure 3 and the at least one second heat dissipation structure 5 for conducting heat produced from the at least one LED 2 during operation from the first heat dissipation structure to towards the at least one second heat dissipation structure. The front side of the first heat dissipation structure comprises at least one upwardly protruding structure 6 extending distally away from the at least one second heat dissipation structure 5 and where the at least one upwardly protruding structure acts as the contact point to the at least one LED.

The thermal connection between the LED and the TEM may be realized by an interface of thermally conducting material, e.g. a metal such as copper or aluminum. By attaching the LED to such a protruding structure on the first heat dissipation structure will speed up the thermal transfer from the LED.

The surfaces of the TEM 4 are typically referred to as the "hot side" and the "cold side", where the cold side is the first surface in contact with the first heat dissipation structure and the hot side is in contact with the adjacent second heat dissipation structure. It should be noted that the temperature gradient of the TEM can be reversed by reversing the current applied to the TEM. This would typically be the case when stable temperature is needed around the LED in an extremely cold environment, To realize the desired efficiency that makes TEM cooling worthwhile, at least one TEM is chosen and configured such that the device can be operated by running a TEM-operating current (referred to herein as TOC) through the TEM. The regulation of the current to the TEM does not follow the junction temperature of the LED but aims at maintaining constant flow of thermal energy through the device creating a sphere of lower level temperature zones around the whole LED increasing the proportion of light versus wasted heat. This will lower the thermal stress inside the semiconductor allowing more light to pass through the holes, further eliminating all heat development inside the chip of the LED, keeping the entropy constant.

When LEDs are viewed in a heat sensitive camera it is observed that very soon after the activation of the LED light, heat starts to develop around the LED and only moves out to colder zones towards the TEM proportional to increased temperature inside the junction this is according to thermal laws.

It is not necessarily desired to obtain cooling of the LED substantially below the ambient temperature; on the contrary. Results have shown that the desired efficiency and energy saving/light gain of the present invention is obtained by keeping the operating temperature of the LED close to or just below the ambient temperature. In some embodiments the operating temperature of the LED may even be slightly higher than the ambient temperature, but importantly, the LED operating temperature is prevented from raising much above ambient temperature, such as would be the case for an LED-lamp with passive cooling in prior art devices where if the ambient temperature is, e.g., about 20-30° C., a non-cooled LED may be expected to warm up during operation and within a relatively brief period reach an operating temperature in the range of about 50-60° C., at which point the illumination of the LED has decreased by about 30-40% or more due to the negative Illumination-temperature coefficient.

The at least one second heat dissipation structure is generally of a conventional type, i.e. with a flat surface that is in contact with the TEM's hot side, while the other side of the heat sink has an extensive surface area to efficiently dissipate the heat to the air in contact with the heat sink. The inventors have discovered the importance of the heat sink design, specially the surface area per volume unit heat sink ratio, for the thermal stability of the device. It is a prior art that turbulent air flow, and rough surface, increase the dissipation of heat through the device. By designing the first heat sink with a large surface area high surface-area-tovolume ratio provides a strong "driving force" to speed up thermodynamic processes that minimize thermodynamic free energy.

From the above discussion and analysis it follows that particularly preferred embodiments of the invention relate to devices configured such that the device produces more illumination per unit consumed power when the TEM-operating current (TOC) is applied to the TEM, than the Illumination produced per unit consumed power when no TOC is applied to the TEM. For example, if the TOC consumes 30% of the energy consumed by Leeds of a multi-LED lamp, the total energy consumption is 130% when the device is being cooled and 100% If the device is operated with no cooling; if this prevents the diodes from warming up and loosing 50% light output, the number of diodes in the lamp can be halved in the cooled lamp to obtain the same light intensity, reducing the LED energy to 50% and thus the overall energy consumed is 80%, i.e., a net energy gain of 20% can be obtained in this example by cooling the Leeds in accordance with the invention.

In one embodiment the LED system comprises a plurality of TEMs. These may arrange side by side, e.g., each arranged to cool a set of LEDs. Also, TEM may be arranged in a stacked fashion, such that two, three or more TEM form a "sandwich" wherein the TEM closest to the LEDs has its hot side thermally connected (either directly adjacent or connected with a thermally conducting material) to the cold side of a second TEM, which also may have its hot side connected to the cold side of a third TEM and so forth. The layers of the stacked TEMs may overlap or bridge two or more TEMs of the next layer so as to provide multiple routes for heat transfer. When using such stacked TEM, the heat sink can be seen as comprising the combination of the additional TEMs, any intermediate heat-conducting plates and the heat sink itself furthest away from the LED in the sandwich of components.

The LED system according to the present invention comprises in one embodiment a control unit for controlling and even reversing the TOC, and one or more sensors connected to the control unit for sensing one or more environmental parameters, wherein the control unit may be configured to adjust the TOC based on parameters measured by the one or more sensors.

It may in some cases be beneficial to operate the TEM with an electronic controller able to maintain the temperature around the LED.

It may in some cases be beneficial to operate the device with (PWM) pulsed current to the one or more LEDs, e.g. such that current pulses alternate between different LEDs of the device and or for one or more thermo electric devices.

In certain embodiments the device may be operated with pulse with modulated current (PWM) to the one or more TEMs, e.g., in further embodiments, it may be beneficial to operate the device with pulsed current to the one or more LEDs and/or TEMs, e.g., such that current pulses alternate between different LEDs and/or TEMs of the device.

In one embodiment, the LED is a high flux light (HB-LED), emitting diode (LED) and at least one thermoelectric module (TEM) thermally connected to the first heat dissipation structure, and a second heat dissipation structure that having a larger volume then the first heat dissipation structure; wherein the at least one TEM is selected and configured such that by running a TEM-operating current (TOC) through the TEM, the thermal power produced by the at least one LED is transferred through the first heat sink already cooling the microclimatic temperature around the LED affecting the overall thermal strain from the light production, at least one TEM to the heat sink, thereby maintaining or lowering the temperature surrounding the LED and enhancing the light output from the LED, prolonging the expected lifetime of the LED, improving the CRI; the device thus consuming less overall power per amount of emitted light when the TEM is running as compared to the overall power per same amount of light when the device is operated without running an operating current through the TEM.

In a further aspect, the invention provides a method for enhancing the efficiency of an light illuminating device having one or more LEDs as a light source, comprising: providing the device with one or more thermoelectric module(s) (TEM) having a cold surface and a hot surface, such that the cold surface is thermally connected to a heat sink with a relative ratio between surface area and volume higher than 2 and the hot surface of the TEM is thermally connected to a bigger heat sink; applying a TEM-operating current (TOC) to the one or more TEMs to create a temperature gradient through the TEM; adjusting the TOC such that substantially all of the thermal energy created by the LED(s) when operated is transferred to the heat sinks, so that the smaller heat sink has a lower temperature than the measured ambient temperature, thereby substantially maintaining the operating temperature of the LED(s) at ambient temperature or a lower temperature, wherein the TEM is configured and TOC adjusted such that the device consumes less overall power per amount of emitted light when the TEM is running as compared to the overall power per same amount of light when the device is operated without applying a TOC to the TEM.

Figure 2:
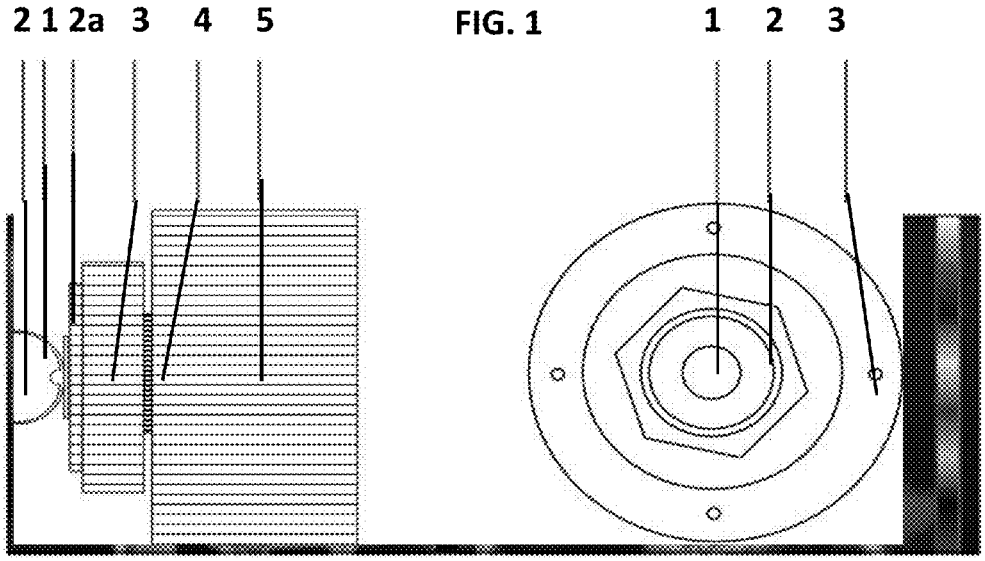
FIG. 2 shows a thermal picture of the preferred embodiment (FIG. 1) during operation, showing the essence of this invention. (3) The first heat sink is colder than (5) the second heat sink. This creates colder than or the same as the ambient temperature around the (1, 2) light production and or other semiconductors.
Figure 3:
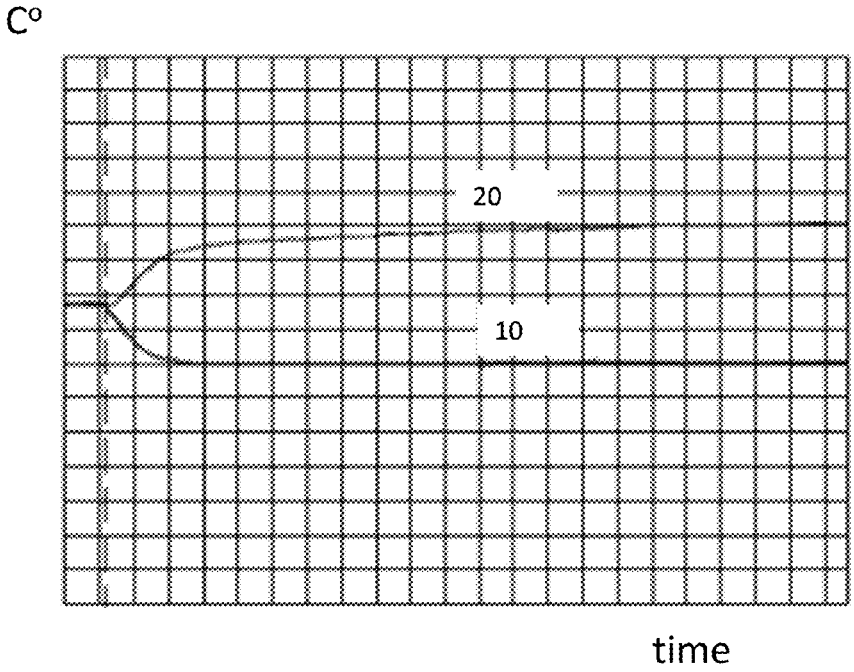
FIG. 3 shows a temperature measurement of the preferred embodiment showing: (10) the temperature at the (3) first heat sink and (20) the temperature at the (5) second heat sink as a function of time.
Figure 4:
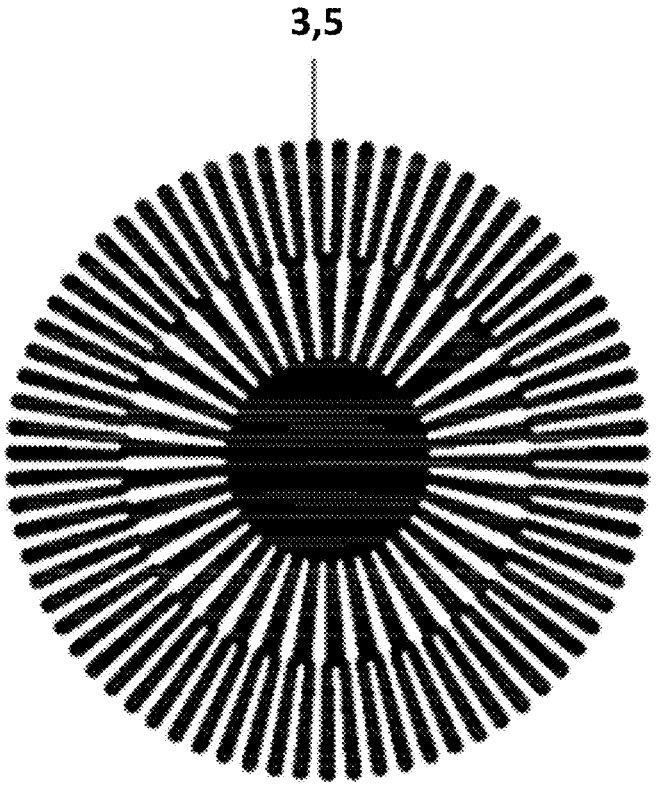
FIG. 4 shows an embodiment of the (3) first and (5) second heat sink, in plan view. Utilizing a high conductivity metal namely, but not limited to extruded, cut and or carved aluminum. The heat sink having as large circumference as possible. According to prior art, this will provide for a relative large surface area/volume ratio, producing stability in temperature during the operation of the light and or other charged semiconductors.
Figure 5:
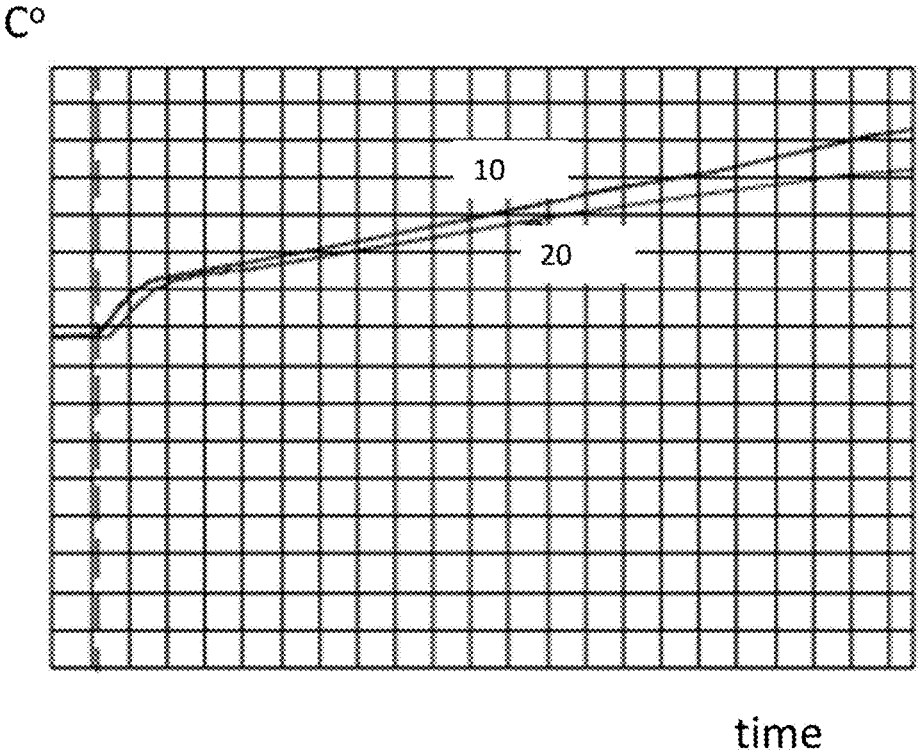
FIG. 5 shows a diagram of a thermal development in the device over time when operated with passive (3, 5) heat sinks only. Only the TEM is turned off. (10) The temperature at the (3) first heat sink and (20) the temperature at the (5) second heat sink as a function of time.

The embodiment described herein is shown in FIG. 1 and may comprise a High Brightness (HBLED) 2 LED and or semiconductors and a lens 2*a* to shape the light beam. As depicted here, the TEM may be integrated into two heat dissipation structures 3, 5 and creates a lower than ambient temperature zone around the first heat dissipation structure (3) first heat sink creating lower thermal strain on the (2) origins and reflection of the illumination. (FIG. 2) This changes all calculations regarding thermal management of the LED by reducing the thermal energy and or withholding constant entropy level inside the semiconductor material. The combination of (3, 5) heat sinks and the placement of the (4) thermo electric device between them, creates a lower temperature zone around the LED 2. The ratio between the surface area and the volume of the first heat dissipation structure is preferably higher or the same as per unit measurement. The second heat dissipation structure 5 preferably has a higher thermal capacity than the first heat dissipation structure 3. Turbulent air flow and roughness of the surface of the heat dissipation structures, further improves the stability of the thermal environment. By holding the entropy constant inside the semiconductor material of the LED creates a maximal photon output and or optimal computing capacity. This stability in temperature is shown in FIG. 3, which reduces LED degradation and or the performance of the semiconductors with prolonged life time of the device as a result and or in groups in any application using HBLED s.a. critical outdoor applications for the purpose of light signaling and or wide area illumination type applications, as well as indoor spotlights and or in general lighting. Depending on the IP grading of the fixture, the LED system may comprise a closed or open chamber. It may be insulated; if used, with any high thermally resistant material s.a. aero gel type material to prevent ambient heat from loading the total heat removal and creating a spatially larger cooling area around the origin of the illumination. It can be without any insulation and it can have vacuum. A single LED may be attached to a single heat dissipation structure that may have a high ratio of surface area per volume heat dissipation structure and a low thermal resistance. Outside the chamber, if used is a thermo-electric module with the cold side facing the heat dissipation structure and the hot side is attached to a larger volume heat dissipation structure 5. The LED may be of a high brightness type of LED capable of producing 60-250 lumens per watt and above If the LEDs are arranged within a housing the thermoelectric module may also be attached to the housing, and/or be an integrated component of said housing.

The LEDs may be grouped in any geometrical order and attached to any curved and/or even surface. The angularity and alignment of LEDs (1) for the purpose of illumination and signaling is not an issue in this invention. It is the prolonged lifetime, better CRI and prevention of the Droop effect in LEDs that is the issue of this invention for the benefit of all LED based fixtures. The thermoelectric module may be of Peltier type having, as already stated, one side hot and the other cold when activated with an electric current. The cold side is facing the first heat dissipation structures 3. The said heat dissipation structures having a ratio between the surface area and the volume of the heat dissipation structures 3 is attached to the LED (1) or could be directly mounted on the LED. A thermally conducting metal plate may be attached to the hot side of the TEM 4. Insulating chamber can be constructed around the electrical components when humidity levels can harm the components. It is important to have the right proportion between air/gas and insulation inside the chamber. Air in particular is a good insulator if the air has no movement and to prevent back flow of heat in the system air/gas has a very low thermal conductivity and even in very thin layers they are capable of insulating and or stopping the heat flow. The transition between the hot side of the TEM and the heat sink is preferably a vapor free material and able to withstand e.g. 1 bar pressure. The described embodiment can be constructed having two chambers or more. Chamber 1(A) is for the LEDs and the first heat sink. The chamber (1) can be filled with dry air or other gases (inert gases) to a higher air pressure than average ambient pressure to prevent the flow of gases (in particular ambient air carrying moisture) into the chamber. The chamber (1) can be filled with gases other than air, e.g. Nitrogen, Argon or Helium, to further prevent moisture inside the chamber. A second chamber can be constructed surrounding the space (B) to ensure more efficient movement of heat from the thermally conducting plate to the final heat dissipation structures—and then to the support structure. Chamber 2 may constructed around the 1 chamber with the peltier attached to the first heat sink and the second heat sink providing for a relative fast enough heat flow from the LED through chamber 1 over to the hot side of the peltier and finally the second heat sink. This flow is always faster than the heat flow through chamber 1. Therefore the first heat sink cools down below the ambient temperature. Thermally conductive materials are used near the light production inside the LED and through chamber 1 removing the heat from the air/gas faster than the ambient temperature is entering chamber 1 because the first heat sink has a lower temperature the heat flow comes naturally according to thermal laws from the LED to the second heat dissipation structures. The higher the delta T the faster the heat flow.

Figure 6:
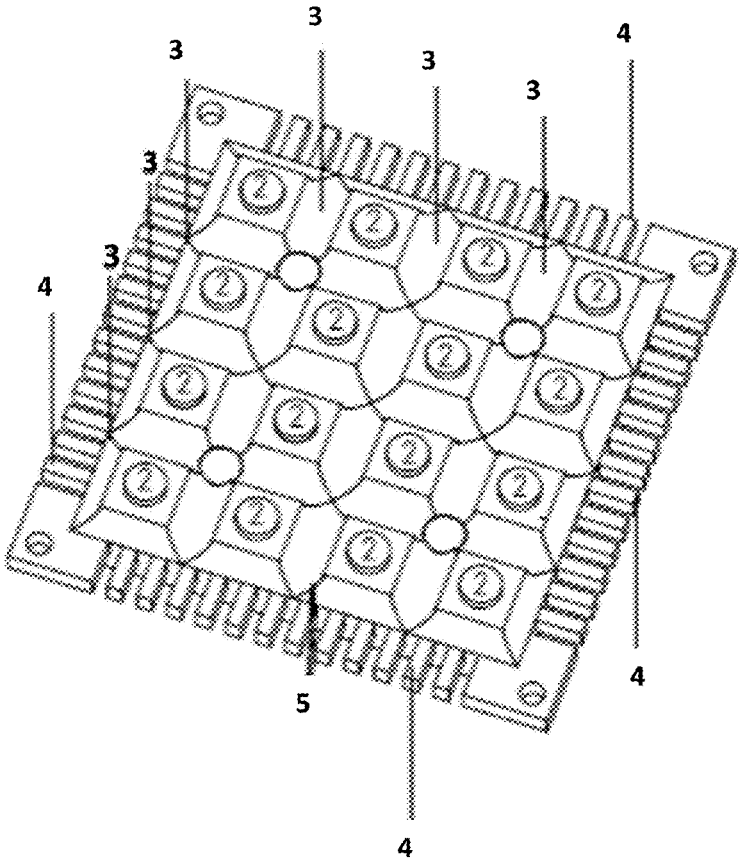
FIG. 6 shows a perspective view of the heat dissipating plate where the heat sources are mounted to it at the upwardly protruding structures.
Figure 7:
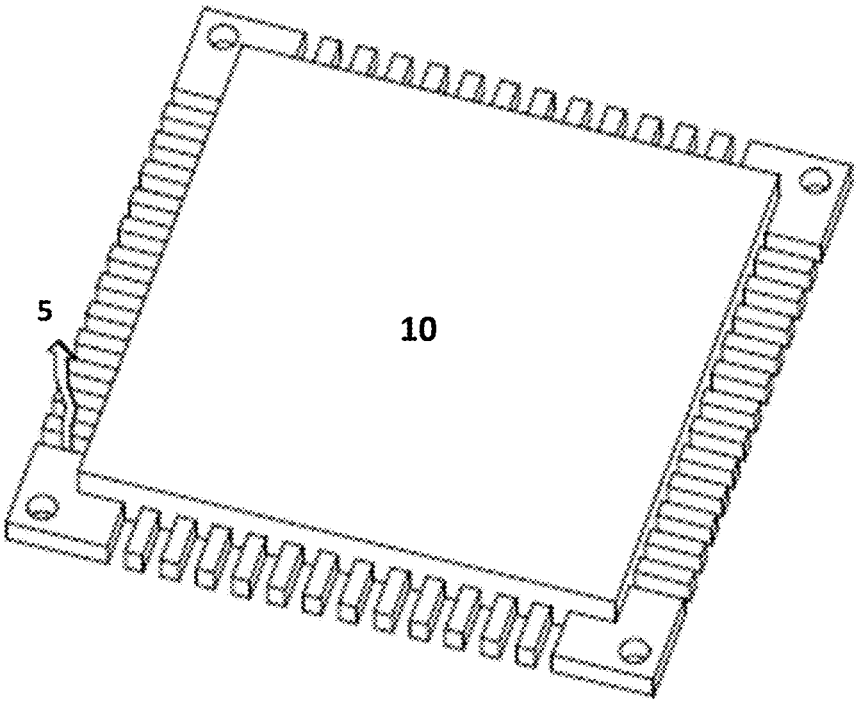
FIG. 7 shows a section drawing view of the heat dissipating plate. The thermoelectric devise and the heat sink is mounted here.
Figure 8:
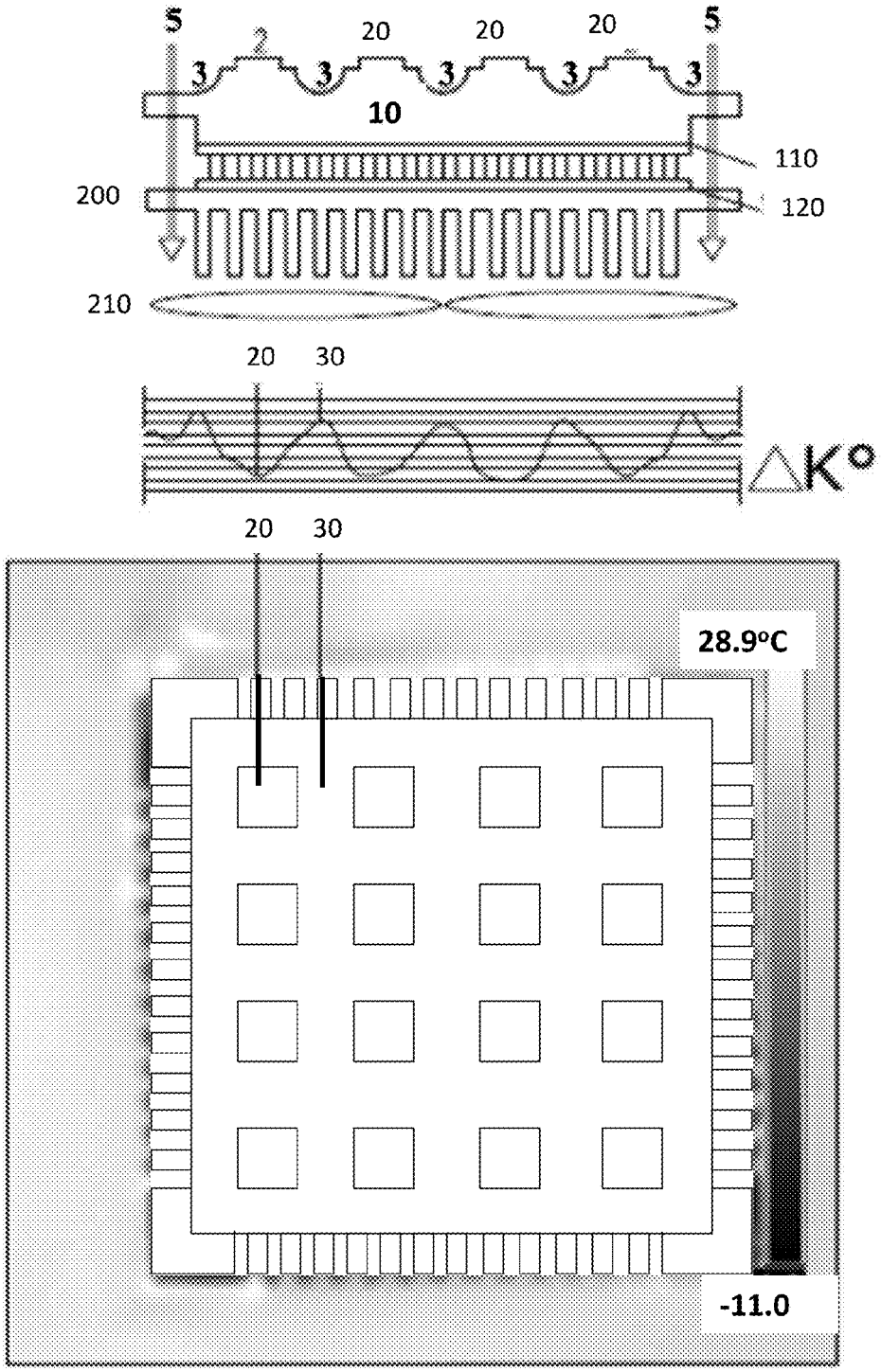
FIG. 8 shows a thermal picture in grey scale. The temperature shown goes from black to white up, whereas the black color shows the lowest surface temperature.

FIGS. 6-8 shown an embodiment of a LED system according to the present invention the front side of the first heat dissipation structure comprises a plurality of upwardly protruding structures forming an array like front side of upwardly protruding structures each of which acting as a contact point to a respective LED.

FIG. 6 showing an embodiment where the first heat dissipation plate as the first contact to LEDs, which may be high flux LEDs. The LEDs may be attached to the first heat dissipation structure via e.g. the thermal connection area on the LED and an equal area 20 on the heat dissipating plate. Not limited to this embodiment the thermal energy spreads from the heat source, i.e. the LEDs, towards the cold side 11 of the thermoelectric device via valleys/groves 30 between adjacent upwardly protruding structures 50. The development of the thermal flow shows when plural heat sources/LEDs are in operation attached to the first 100 heat dissipating plate, areas in the valleys/groves have a higher temperature than surrounding areas. Similar development is shown for the edges of the heat dissipating plate. They have an increased surface area by fins 40 and moving air 50. Blowing through the fins 40 the fins show also a higher temperature than surrounding areas. By moving the thermal flow from the heat source/LEDs in this way, through the first heat dissipating plate the thermal velocity in the first heat dissipating plate becomes uneven, which distorts even distribution of S (Entropy) through the first heat dissipating plate. As S increases inside the closed systems of the LEDs in normal configurations, the S in subject art heat dissipating plate does not stay and increase inside the LEDs but is removed from the LEDs to the groves 30 and through the thermoelectric device 11 into a heat sink 200 attached to the hot side (120) of the thermoelectric device 110.

Figure 9:
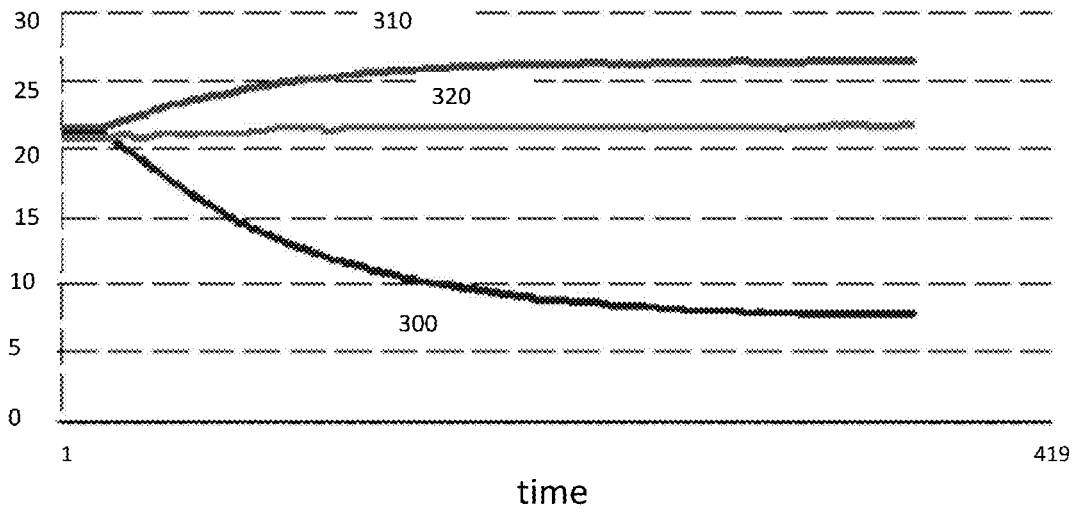
FIG. 9 shows a diagram of three temperature measurements. There are three curves shown as functions of time. The curve with the highest temperature is the measurement at the heat sink attached to the hot side of the thermoelectric device, the curve in the middle is the ambient temperature during the measurement time. The lowest curve is the temperature at the cold side of the thermoelectric device. The diagram confirms the purpose of this invention to create a cold stable climate for electric devices that create multiple hot spots.

The comparison of two different approaches, forming heat dissipating plates, show that subject matter solution prevents the overall heat from multiple heat sources to interact as one uniform heat development. By changing the scalar velocity and thermal resistance in the first heat dissipation plate the contact area between any heat sources smaller than the heat dissipation plate improves the thermal environment for any electric device needing effective heat dissipation in order to operate optimally. In FIG. 8 this is demonstrated by showing a thermal picture of the surface of the heat dissipating plate. It is a snapshot of the heat development during operation. Lighter areas are warmer than the darker areas. The thermal flow is faster from the contact areas 20 than in the valleys/groves 30 where the thermal velocity slows down and thereby increasing the thermal resistance in the said grove 30. The LED system directs the thermal energy from the heat dissipating plate according to the second law of thermodynamics. By making a thermal gradient in the thermoelectric device with electric current, then facing the cold side to the back side 100 of the heat dissipating plate. Temperature measurements during operation show (FIG. 8) Temperature for the cold side 300 of the first heat dissipating plate is far below the ambient temperature 310, when temperature for the hot side 320 of the subject art is above the ambient temperature 310. The measurement shows further that the thermal development is stable after some time of operation. Thermal distribution in the first heat dissipating plate is shown in FIG. 9. Contact areas 20 (see FIG. 9) are colder than the groves 3. This configuration of the heat dissipating plate enhances the capabilities of the heat dissipating plate, pawing for better operation of electronic devices where heat dissipation is essential for optimal operation of the electronic device.

Figure 10:
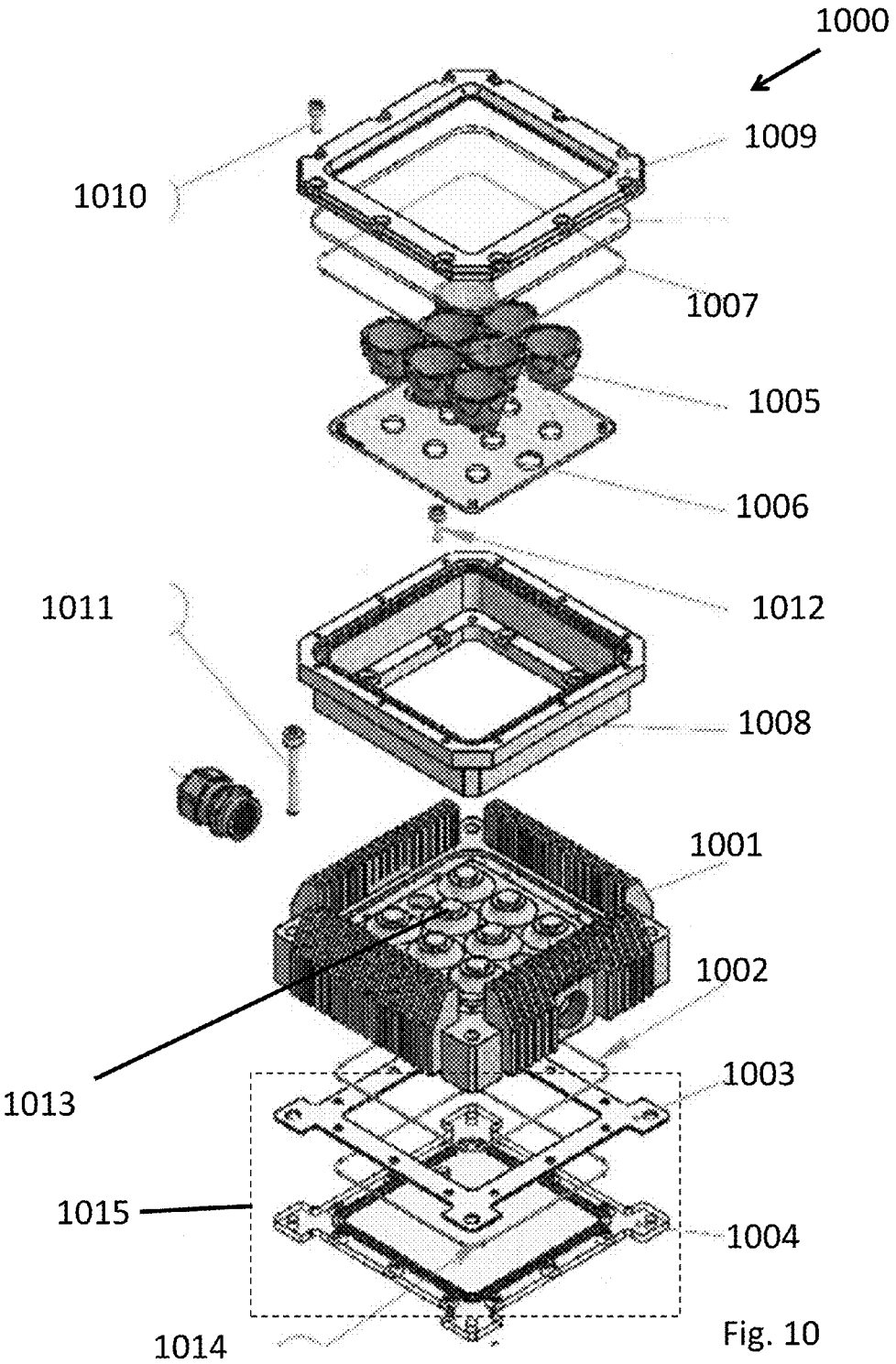
FIGS. 10 and 11 show another embodiment of LED system according to the present invention.

FIG. 10 shows one embodiment of the LED system 1000 according to the present invention, where the front side of the first heat dissipation structure 1001 comprises a plurality of upwardly protruding structures 1013 forming an array like front side of upwardly protruding structures each of which acting as a contact point to a respective LED 1005. In this case, the number of upwardly protruding structures is eight, but the number may just as well be less than eight, or be more than eight. Shown in also an example of a thermoelectric module 1015, e.g. the above mentioned thermoelectric cooler (TEC) having a first side 1003 and a second side 1004 with a sealing material 1014 arranged there between, where the at least one TEC may be connected to a power source (not shown) that supplies electrical current and thus electrical energy into the at least one TEC. Another sealing material 1002 may also be provided between the TEC and the first heat dissipation structure 1001. In this case, the number of TEC is only one, but as discussed previously the number of TEC as well as the number of the second heat dissipation structure (not shown here) may be more then one. As an example, two TEC may be provided with two second heat dissipation structure (three with three etc.) such that a sandwich like arrangement is formed. Shown is also a circuit board 1006 that is connected to a power source (not shown) for supplying electrical current to the LEDs.

As depicted here, the LED system 1000 may also comprise a housing comprising an upmost frame 1009 and an intermediate frame 1008 with one or more transparent material 1007 such as glass or plastic. Several bolts and/or screws 1010-1012 may also provided to mount this LED system assembly together.

Such a LED system may e.g. be implemented as a traffic light, street light etc.

Figure 11:
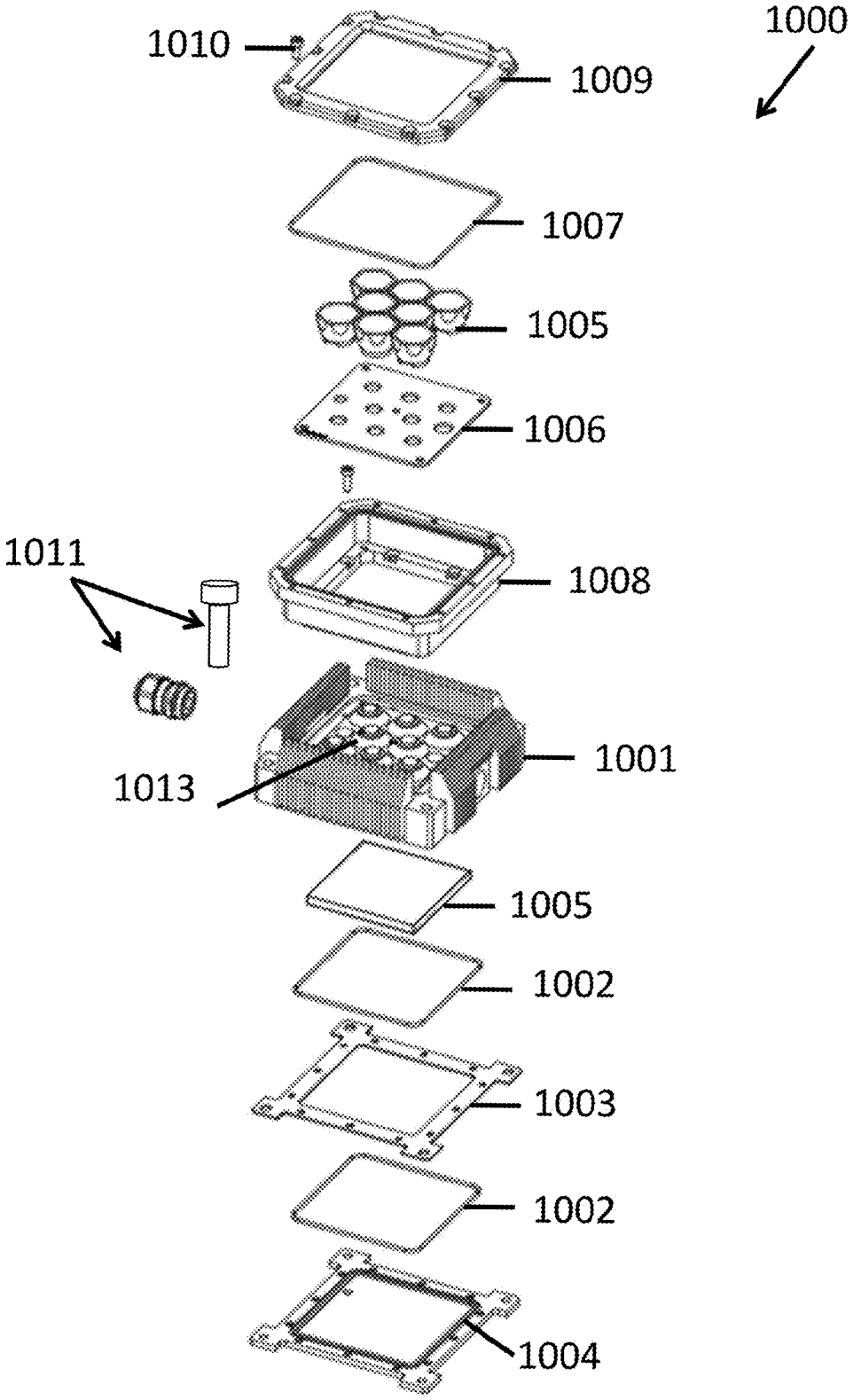

FIG. 11 shows the LED system in FIG. 10, but additionally with thermoelectric module 5000 such as peltier.

The invention claimed is:

1. A light emitting diode (LED) lighting system, comprising:

a first heat dissipation structure having a front side and a back side, the front side acting as a contact area to at least one LED;

at least one second heat dissipation structure positioned adjacent to the backside of the first heat dissipation structure; and at least one thermoelectric module positioned between the first heat dissipation structure and the at least one second heat dissipation structure for conducting heat produced from the at least one LED during operation from the first heat dissipation structure to towards the at least one second heat dissipation structure, wherein the front side of the first heat dissipation structure comprises at least one upwardly protruding structure extending distally away from the at least one second heat dissipation structure and where the at least one upwardly protruding structure acts as at least one contact point to the at least one LED, and wherein the front side of the first heat dissipation structure comprises a plurality of upwardly protruding structures forming an array like front side of upwardly protruding structures, where the upwardly protruding structures act as at least one contact point to at least one LED selected from plurality of LEDs.

2. The LED system according to claim 1, wherein the at least one upwardly protruding structure has a conical shape.

3. A light emitting diode (LED) lighting system, comprising:

a first heat dissipation structure having a front side and a back side, the front side acting as a contact area to at least one LED;

at least one second heat dissipation structure positioned adjacent to the backside of the first heat dissipation structure; and at least one thermoelectric module positioned between the first heat dissipation structure and the at least one second heat dissipation structure for conducting heat produced from the at least one LED during operation from the first heat dissipation structure to towards the at least one second heat dissipation structure, wherein the front side of the first heat dissipation structure comprises at least one upwardly protruding structure extending distally away from the at least one second heat dissipation structure and where the at least one upwardly protruding structure acts as at least one contact point to the at least one LED, and wherein the respective one of the at least one thermoelectric module comprises at least one thermoelectric cooler (TEC) having a first side and a second side, where the at least one TEC is connected to a power source that supplies electrical current and thus electrical energy into the at least one TEC, where the TEC converts the electrical energy into a temperature gradient between the first and the second side along a vertical axis through the heat dissipating structures so as to allow the heat conduct from the first heat dissipation structure towards the at least one second heat dissipation structure.

4. The LED system according to claim 3, wherein the at least one TEC are controlled by a control unit and where the controlling includes adapting the supplied electrical energy to the ambient temperature.

5. The LED system according to claim 3, wherein the at least one TEC are controlled by a control unit and where the controlling includes adjusting the current into the TEC such that the heat flow from the first heat dissipation structure towards the at least one second heat dissipation structure remains substantially constant.

6. The LED system according to claim 3, wherein the at least one TEC are controlled by a control unit and where the controlling includes maintaining stable temperature around the at least one LED by means of reversing the temperature gradient between the first and the second side of the at least one TEC, and vice versa, by means of reversing the temperature gradient between the second and the first side of the at least on TEC, by means of reversing the current applied to the TEC.

7. The LED system according to claim 1, where the number of repetition between a second dissipation structures and thermoelectric modules is adapted to the geometrical size and or the power of the LED lighting system, where the larger or the more power the LED lighting system is the more will the repetition be between the second dissipation structure and thermoelectric modules.

8. The LED system according to claim 1, wherein the surface/volume ratio of the first and/or the at least one second heat dissipation structure is two or more.

9. The LED system according to claim 1, wherein the at least one second heat dissipation structure defines at least one plate structure.

10. A heat dissipation structure having a front side and a back side adapted to be used in relation to a light emitting diode (LED) lighting system according to claim 1, where the heat dissipation structure has a front side adapted to act as a contact area to at least one LED and a back side, where the front side comprises at least one upwardly protruding structure adapted to act as at least one contact point to the at least one LED.

* * * * *